US005876195A

United States Patent [19]

Early

[11] Patent Number: 5,876,195

[45] **Date of Patent: *Mar. 2, 1999**

[54] LASER PREHEAT ENHANCED IGNITION

[75] Inventor: James W. Early, Los Alamos, N. Mex.

[73] Assignee: The Regents of the University of California, Los Alamos, N. Mex.

[ * ] Notice: This patent issued on a continued prosecution application filed under 37 CFR 1.53(d), and is subject to the twenty year patent term provisions of 35 U.S.C. 154(a)(2).

[21] Appl. No.: 656,110

[22] Filed: May 31, 1996

[51] Int. Cl.[6] ..... F23D 11/44

[52] U.S. Cl. ..... 431/11; 431/258; 123/143 B; 60/39.828; 60/39.821

[58] Field of Search ..... 123/143 B, 143 R; 60/39.828, 39.821; 431/6, 11, 258

[56] References Cited

U.S. PATENT DOCUMENTS

| | | | |
|---|---|---|---|
| 3,427,118 | 2/1969 | Andress et al. | 60/39.821 |
| 4,302,933 | 12/1981 | Smith | 60/261 |
| 4,416,226 | 11/1983 | Nishida et al. | 123/143 R |
| 4,434,753 | 3/1984 | Mukainakano et al. | 123/143 R |
| 5,120,332 | 6/1992 | Wells | 55/208 |
| 5,328,665 | 7/1994 | Geiger | 123/143 B |
| 5,367,869 | 11/1994 | DeFreitas | 60/39.06 |
| 5,404,712 | 4/1995 | Few et al. | 60/39.06 |
| 5,485,720 | 1/1996 | Few et al. | 60/39.821 |
| 5,497,612 | 3/1996 | Few et al. | 60/39.06 |

*Primary Examiner*—Carroll B. Dority
*Attorney, Agent, or Firm*—Gemma Morrison Bennett

[57] ABSTRACT

A method for enhancing fuel ignition performance by preheating the fuel with laser light at a wavelength that is absorbable by the fuel prior to ignition with a second laser is provided.

11 Claims, 11 Drawing Sheets

LASER PREHEAT ENHANCED IGNITION

This invention was made with government support under Contract No. W-7405ENG-36 awarded by the U.S. Department of Energy. The government has certain rights in the invention.

TECHNICAL FIELD

This invention relates to laser ignition of hydrocarbon fuels.

BACKGROUND ART

Laser light has been used to initiate the ignition of fuel/oxidizer mixtures for more than a decade. Recent developments have included laser induced ignition of liquid fuel aerosols to overcome problems with capacitive discharge igniters. State of the art laser-based ignition processes use a laser-spark, air-breakdown ignition method in which a single, high peak-power, short duration laser light pulse is used to initiate fuel ignition via the generation of a high temperature, air-breakdown, ionization plasma. The performance of this spark breakdown ignition method to reliably ignite fuel aerosols is limited to a narrow range of fuel parameters such as fuel/oxidizer ratios, fuel droplet size, number density and velocity within a fuel aerosol, and initial fuel and air temperatures.

Laser spark breakdown ignition of fuel/oxidizer mixtures occurs basically in four steps: (1) non-resonant multiphoton ionization of gas molecules generating a light absorbing plasma via electron cascade; (2) deposition of thermal energy and vaporization of fuel droplets; (3) initiation of combustion through both thermal and photo-chemical reaction of fuel and oxidizer; and (4) formation and propagation of the flame kernel to regions outside the initial site of plasma formation.

The plasma formation of step (1) requires the application of high pulse energy and high peak power density laser light. This requirement necessitates the use of a large-sized laser source and short duration laser pulses which are no more than tens of nanoseconds in pulse length. High peak laser power can cause the formation of intense shock waves within the ignited fuel which can cause self-extinguishing of the laser induced ignition flame.

Typically, a Q-switched laser with a pulse width and pulse energy which will provide the high peak power density required to initiate plasma formation is used to initiate plasma formation and satisfy concurrently the need for time-averaged power for sustaining ignition.

Therefore, there is a need for an energy efficient process for initiating and sustaining the ignition of a broad range of aerosol fuel/oxidizer mixtures.

There is also a need for a laser ignition process which can reliably ignite aerosol fuel mixtures within a broad range of parameters such as fuel/oxidizer ratios, fuel droplet size, number density and velocity within a fuel aerosol, and initial fuel temperatures.

Economical improvements in ignition technology are also needed.

Therefore, is an object of this invention to provide a method for improved ignition performance.

It is another object of this invention to provide a method for initiating and sustaining ignition of aerosol fuel.

It is yet another object of this invention to provide a laser ignition method having reduced peak power requirements.

It is a further object of this invention to provide a method of laser ignition which can use a smaller, less complex laser.

It is still another object of this invention to provide a fuel pre-heat method for enhancing the stability of fuel combustion.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DISCLOSURE OF INVENTION

To achieve the foregoing and other objects, and in accordance with the purposes of the present invention, as embodied and broadly described herein, there has been invented a method comprising:

(a) contacting a fuel aerosol with laser light at a wavelength that is absorbable by droplets of said fuel aerosol, thereby producing a hot cloud of vaporized fuel; thereafter, (b) contacting said vaporized fuel with a second laser light pulse of sufficient intensity to ignite said vaporized fuel.

BRIEF DESCRIPTION OF THE DRAWINGS

The accompanying drawings, which are incorporated in and form a part of the specification, illustrate some of the embodiments of the present invention and, together with the description, serve to explain the principles of the invention. In the drawings.

BEST MODES FOR CARRYING OUT THE INVENTION

Figure 1:
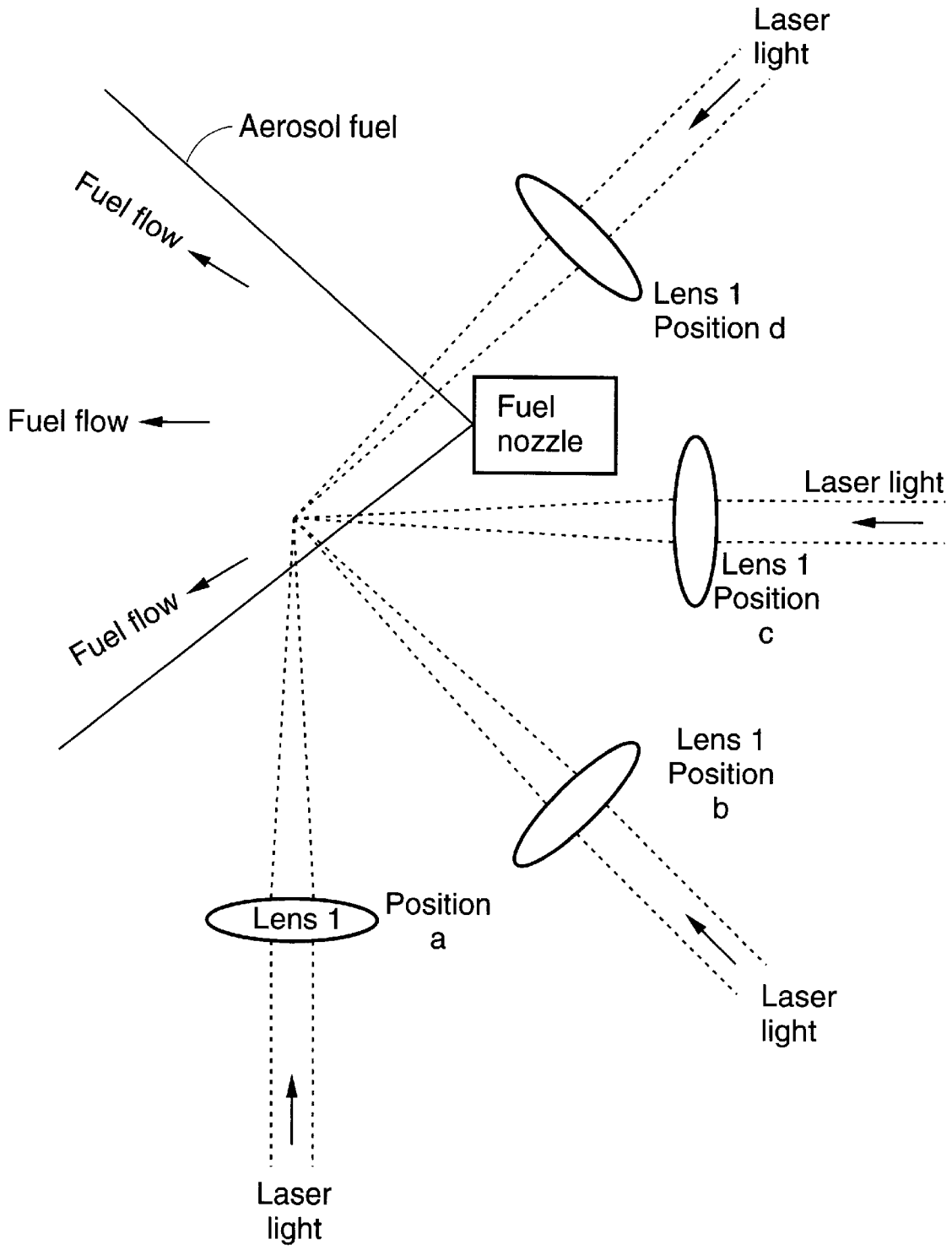
FIG. 1 is a schematic showing different positions of a single focusing lens.

It has been discovered that wavelengths of laser light which are readily absorbed by hydrocarbon fuels can be used to preheat and vaporize individual fuel aerosol droplets within an aerosol fuel spray, thereby greatly improving the performance of laser spark induced ignition of these fuels.

Furthermore, we have discovered that this invention can be used for stabilization of combustion flames.

Unlike conventional laser spark fuel ignition which uses a single, high peak power laser pulse to supply the necessary thermal energy to both heat and vaporize aerosol fuel droplets as well as to initiate and sustain fuel combustion, the novel ignition method of this invention utilizes two laser pulses which perform separate tasks within the over-all ignition process.

A first laser pulse applied to the fuel medium heats fuel droplets to their boiling point which completely vaporizes fuel aerosol droplets within the focused laser light. For Jet A fuel as well as for many other aerosol fuels, the fuel boiling point (about 200° F.) is typically below the auto-ignition temperature of the fuel (about 300° F.); therefore spontaneous ignition of the heated, vaporized fuel typically does not occur during application of the first (preheating) laser pulse.

To provide optimal efficiency in the preheating and vaporization of aerosol fuel droplets, the wavelength of laser light from the first laser light source must be efficiently absorbed by the fuel medium. This requires a laser which produces light at a wavelength which coincides with an absorption band of the fuel and provides sufficient pulse energy to vaporize fuel droplets contained within the focal volume of the focused laser light.

The desired wavelengths for the first (preheating) laser light fall within the C—H and O—H vibrational absorption bands of the hydrocarbon fuel, i.e, in the wavelength range of 2.0 to 4.0 microns. Although this fuel absorption band is readily accessed by solid state lasers, several strong light absorption bands for Jet A fuel occur at wavelengths ranging between 8 and 12 microns which can be addressed by gas lasers.

Suitable lasers which can be used for generating the first laser pulse include Er:YAG lasers operating at 2.94 microns, a wavelength which is readily absorbed by fuel hydrocarbons. Various lasers with light output which can be frequency mixed to produce harmonic light within this wavelength range also can be used. For example, the invention can be practiced by employing difference frequency mixing of Nd:YAG light at 1064 nanometers and Cr:LiSAF laser light in the wavelength range of 800 to 950 nanometers.

Absorption bands in the wavelength range of 8 to 12 microns also can be used in this invention to preheat fuel droplets. The laser light within this wavelength range is provided by gas lasers, such as, for example, a $CO_2$ laser or a diode laser.

The first laser may be operated in either a pulsed mode (nanosecond to millisecond duration) or continuous (cw) operating mode. For example, a single 120 microsecond long laser pulse and a series of laser pulses over a 120 microsecond time period with total laser energy equal to that of the single 120 microsecond will yield substantially identical results. The first (preheating) laser is typically operated with a long duration, low peak power output. The output pulse of the first laser is adjusted to some previously determined value by monitoring the signal amplitude at the output of a photodetector positioned between the laser source and the laser light focusing lens.

The desired duration and repetition rate of the preheating laser light pulse to provide optimal delivery of laser energy to the fuel medium depends upon several factors. For the case of a dynamically flowing aerosol of fuel droplets, optimal coupling of laser energy to the fuel medium and subsequent heating of fuel droplets is obtained when the laser pulse duration is less than or equal to the time required for the moving fuel droplets to traverse the region of focused laser light. Generally, the first (preheating) laser light pulse be in the range from about 1 nanosecond to about all the way to a continuous pulse. Generally presently preferred for sequential preheating and ignition pulses are preheating pulses in the range from about 10 nanoseconds to about 1 millisecond. Preferred repetition of laser pulses is 1 to 100 Hz for ignition applications; higher repetition rates of up to 1 KHz are desired for flame stabilization applications.

It is believed that the minimum laser power density required to induce enhanced fuel droplet evaporation and subsequently consistent laser ignition of Jet A fuel aerosols at about 78° F. is about 30 $kW/cm^2$. The laser power density required to vaporize fuel droplets varies with fuel temperature and fuel properties such as laser light absorbance, heat capacity, density, molecular weight and heat of vaporization. As fuel temperature is increased or lowered, lower or higher laser power densities are required to provide fuel vaporization. Laser power densities in the range of 5 $kW/cm^2$ to 5 $MW/cm^2$ generally provide consistent fuel vaporization and subsequent ignition for Jet A fuel aerosols over a broad range of fuel temperature from −40° F. to +120° F. Laser power densities of up to $5\times10^{11}$ $W/cm^2$ or more can be used with the limitation being the size of the laser and risk of damage to the optical transport components.

The laser light from the first (preheating) laser is focused through a light focusing lens onto the fuel droplets contained within the aerosol spray. To induce vaporization of fuel droplets, lenses with a broad range of focal lengths can be utilized. Choice of lenses which can be used depends upon the laser light power density in the focal volume of the lens needed to produce efficient fuel droplet vaporization. Typically, lenses with focal lengths from 1 cm to 100 cm can be employed for the preheating step.

The intense heating of the fuel droplets by interaction of the fuel droplets with the laser light produces a hot cloud of vaporized fuel which expands and mixes with the surrounding air. The air serves as an oxidizer, combining with the fuel to produce an easily ignitable fuel/air mixture.

A second laser source providing light pulses with sufficient intensity to initiate a hot breakdown plasma is then directed through the same lens as the first laser light or through another lens into the vaporized fuel/oxidizer mixture to initiate fuel ignition. The focusing lens is used to properly adjust the power density of the laser light of the second laser to enable spark breakdown within the fuel/oxidizer mixture. The peak power of the second laser pulse is typically adjusted to provide the minimum intensity required to induce a spark breakdown plasma.

The second (ignition) laser light pulse may be of the same wavelength as the preheat laser source, although of higher peak power, or may be produced by a different laser with a different operating light wavelength. The second laser may be a second Er:YAG laser or an Nd:YAG laser, or any other type of laser which can operate in the Q-switched, mode-locked or cavity-dumped mode to provide high peak power pulses.

The significant difference between the first (preheating) laser and the second (ignition) laser is the wavelengths of the laser light outputs. Generally, shorter laser light wavelengths are more desirable for the initiation of a breakdown plasma within the fuel medium during preheat since less peak power in the lasing output is required.

The second laser light source is generally operated with pulse durations in the range from a few picoseconds to several microseconds. Generally, pulse durations in the range from about 0.1 nanoseconds to about 50 nanoseconds are more preferred for application of the second (ignition) laser light. These pulse widths produce a minimum required power density of $1\times10^9$ W/cm$^2$ at modest laser pulse energy. Typically, power densities in the range of $10^{10}$ to $10^{12}$ W/cm$^2$ are preferred to consistently produce a large region of ionization within the fuel medium at the focal plane of the focus lens, although lower power densities of about $10^9$ W/cm$^2$ produce microplasmas due to the focusing action of individual fuel droplets. Usually, ignition performance in the lower power density range is limited.

Typically, a single lens is used to focus both the preheating laser light and the ignition laser light into the fuel aerosol. Choice of lenses which can be used depends upon the minimum laser light power density (about $10^{11}$ W/cm$^2$) at the focal plane of the lens needed to consistently produce a spark breakdown plasma during the application of the short duration, high peak power laser pulse to induce fuel ignition. For ignition of most fuel/oxidizer mixtures, lenses with focal lengths from 1 to 20 cm can be used effectively.

Alternatively, two lenses may be used to separately focus each of the laser pulses. When two lenses are used, the lenses would be positioned so that the focal points of each lens would overlap within the fuel aerosol cloud. Positioning the lenses so that the focal points of each lens overlaps within the fuel aerosol cloud permits greater freedom in the choice of optimal power densities for both the preheating and ignition of the fuel aerosol, at the expense of optical complexity. The range of lenses which can be used to focus the high peak power laser pulse is from 1 to 20 cm, while the range of lenses used to focus the preheating laser light ranges from 1 to 100 cm.

The preferred embodiment of the invention employs a single lens to focus both laser light pulses, since optimal ignition performance is more sensitive to the power density of the laser ignitor pulse than to the power density of the preheating laser pulse.

In a preferred embodiment of the invention, the lens used to focus both the laser preheat pulse and the laser ignition pulse was positioned as focusing lens 1 shown in position a in FIG. 1. In this configuration of the invention the lens is located to provide perpendicular incidence of the laser light to the axis of the aerosol fuel cloud. The lens is moved in the direction of the laser light to position the focused laser light at various distances from the aerosol fuel cloud axis. Generally, best fuel vaporization and subsequent ignition is obtained when the laser light is focused in regions of the fuel cloud in which the droplet number density is highest. For the fuel spray nozzle used in the examples in this patent, highest fuel droplet density was obtained within regions near the outer edge of the fuel cloud.

Other laser light directions with respect to aerosol fuel cloud axes which perform satisfactorily include placements of the laser light focusing lens 1 in positions b, c and d shown in FIG. 1. As can be seen from the figure, the laser light is applied at different angles to the fuel cloud axis. In addition, the laser focusing lens may be placed above or below the plane depicted in FIG. 1, i.e., in a third dimension.

Figure 2:
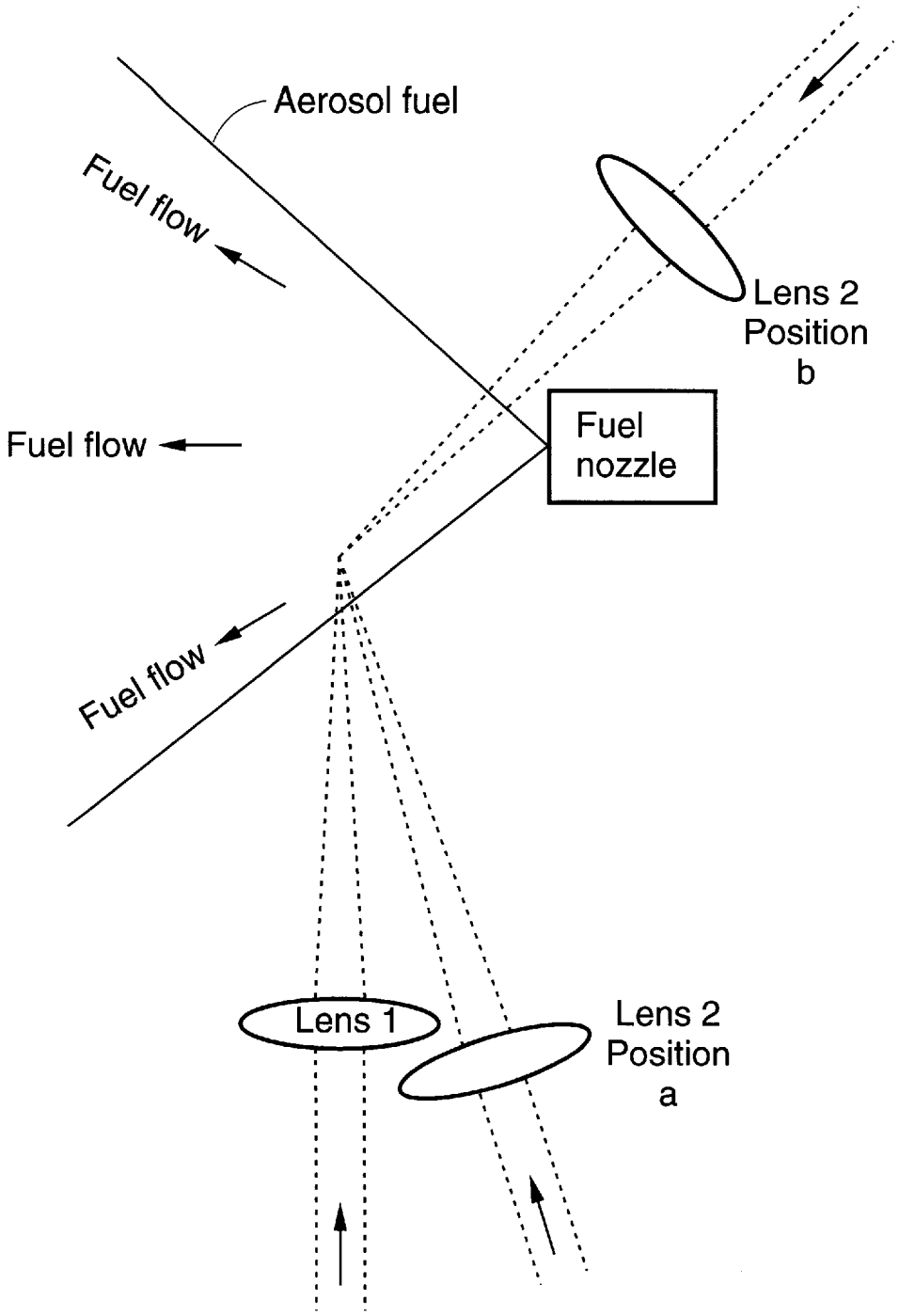
FIG. 2 is a schematic showing different positions of two focusing lens.

In another embodiment of the invention, two lenses may be used to independently focus the preheating and laser ignition pulses. When two separate lenses are used, the two lenses can be positioned closely together to focus the laser light output of the individual lasers to a common location within the aerosol fuel cloud as shown in position a in FIG. 2. Two separate lenses 1 and 2 which are angularly separated, as shown in positions a and b in FIG. 2, can be employed in practice of the invention.

Figure 3:
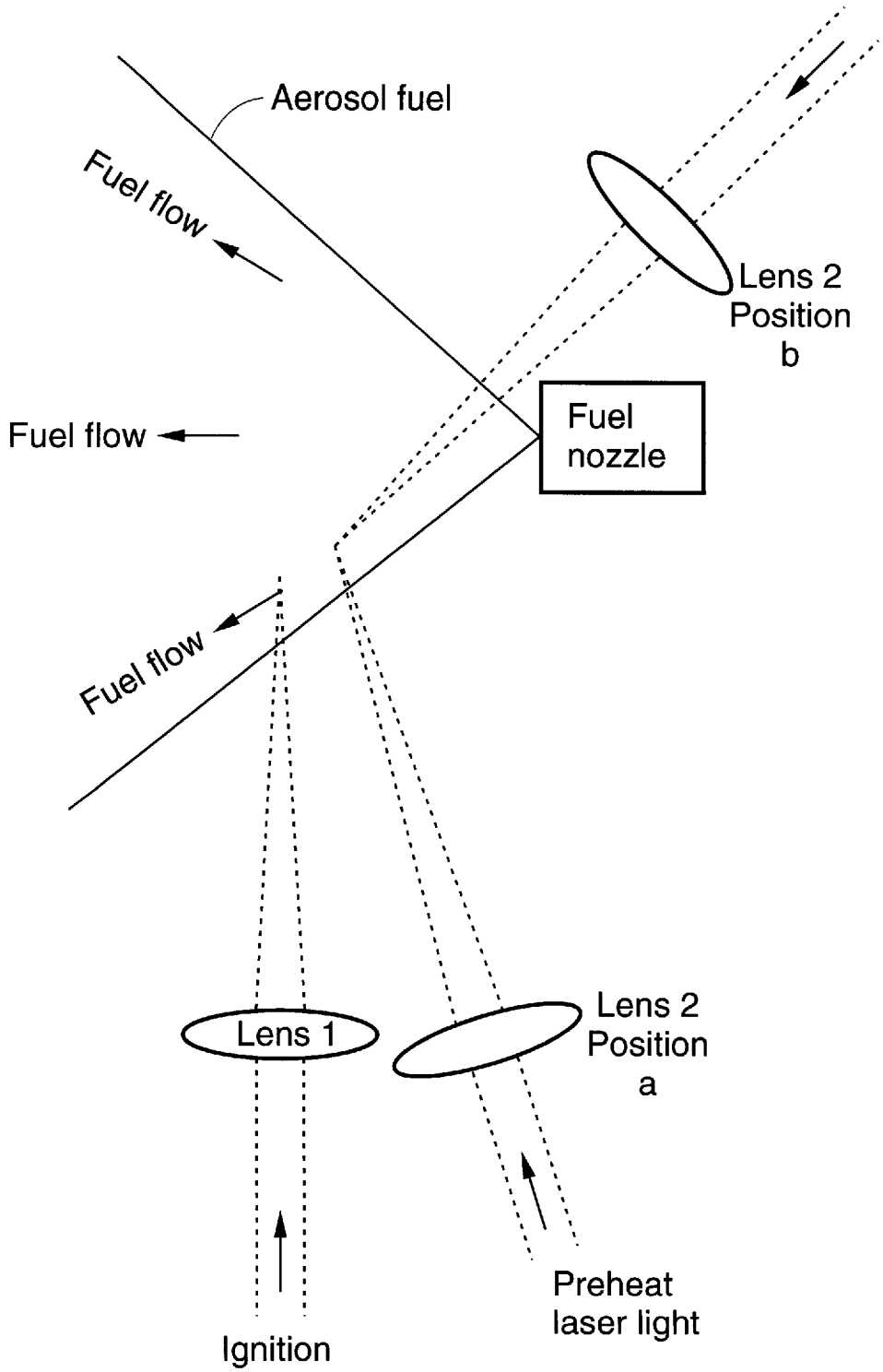
FIG. 3 is a schematic showing different positions of focal points within an aerosol fuel cloud.

Alternatively, when two separate lenses are used, the focal points of the two lenses can be offset spatially in order to heat and/or vaporize fuel droplets at one location within the aerosol fuel cloud and then subsequently apply an ignition laser beam at some downstream location within the aerosol fuel flow. This is illustrated in FIG. 3.

Figure 4:
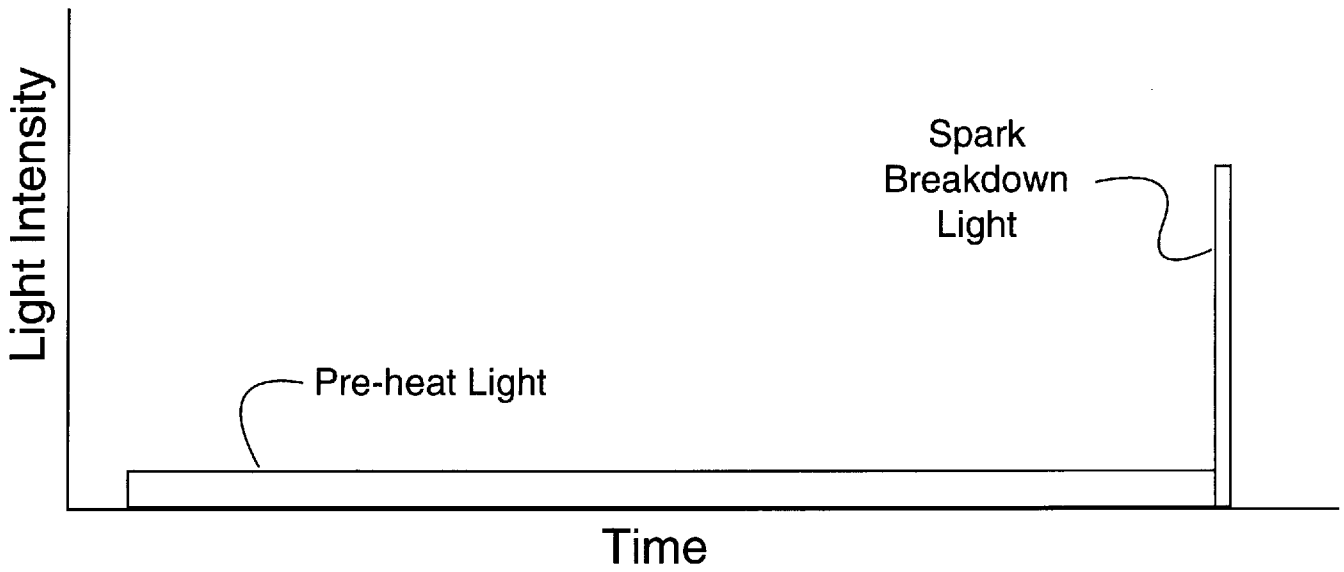
FIG. 4 is a graphic representation of an appropriate pulse sequence for the invention.

FIG. 4 is a graphic representation of the presently preferred pulse sequence for practice of the invention. The elapsed time is plotted along the horizontal X coordinate and the intensity of the laser light pulses is plotted along the vertical Y coordinate. The first block represents the long duration low peak power preheat laser light pulse and the tall slender second block represents the subsequent short duration high peak power igniter laser light pulse.

The sequencing of the application of the laser preheat and laser spark ignition pulses may be varied from that shown in FIG. 4 in order to optimize ignition performance. Experimentally, optimal fuel ignition performance has been obtained at temporal delays between the application of the laser preheat pulse and the laser spark ignition pulse ranging from 0 to 100 microseconds in duration, depending upon fuel droplet size, velocity and initial temperature as well as preheat laser power and focal spot size. This delay is measured as the temporal separation between maxima in the intensity distributions or centroids for the two pulses.

To facilitate simplicity of laser configuration, both preheat and spark igniter laser light pulses may be produced by the same type of laser or same laser source. For instance, both the preheat and the ignition laser pulses could be provided sequentially from the same Q-switched laser. This is accomplished by initially operating the Q-switched laser in the long pulse mode to produce a low peak power laser pulse of several tens of microseconds duration, followed by the application of the Q-switch modulator within the same laser resonator to produce a subsequent high peak power, short duration laser pulse for laser spark ignition.

Possible disadvantages of using a single laser source are: (a) difficulties in producing high peak power laser pulses in the mid-infrared wavelength range where the fuel absorption occurs (Q-switch pulse widths tend to be long, greater than 100 nanoseconds); (b) difficulties in producing two closely spaced pulses due to the low gain and long photon build-up times for mid-infrared wavelength laser materials; and (c) difficulty of transporting high peak power, mid-infrared wavelength pulses due to the low optical damage thresholds of mid-infrared optical fibers.

The laser light beams from both the first (preheating) and the second (ignition) laser sources can be projected directly into a beam combiner optic or one or both of the laser light beams can be projected into a beam combiner optic by way of a laser beam steering system. This arrangement is shown schematically in FIG. 5, which shows a typical setup for the presently preferred embodiment of this invention. The invention setup shown in FIG. 5 comprises a first (preheating) laser 10 to provide low peak power light at a wavelength which is readily absorbed by the fuel droplets, a second (igniter) laser 12 which provides high peak power light of sufficient magnitude to induce a breakdown spark when focused into the fuel aerosol cloud 32, a beam combiner optic 16, a beam splitter optic 22, a photodetector light sensor 24, a laser light focusing lens 28, and a beam steering mirror 18.

The first laser 10 and second laser 12 are securely mounted so as to project laser light beams directly into a beam combiner optic 16 or into a beam combiner optic 16 by way of a laser beam steering system 18. The beam combiner optic 16 and laser beam steering system 18 are employed to provide co-axial propagation of the combined laser outputs to the focusing lens 28 and subsequent spatial overlap in the focal volume of the laser light focusing lens 28.

Figure 5:
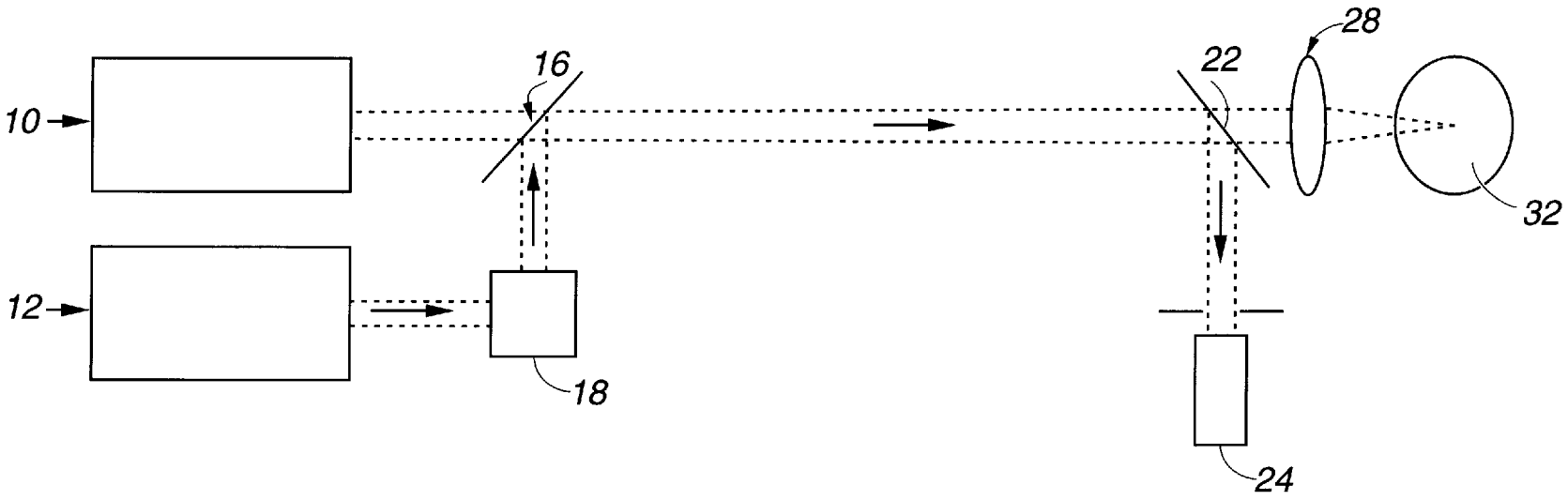
FIG. 5 is a schematic for a dual laser setup to practice a preferred embodiment of the invention.

Still with reference to FIG. 5, the beam combiner optic 16 and laser beam steering mirror 18 are mounted or positioned so as to intercept the laser pulses from one or both of the laser sources 10 and 12. The laser light output of the preheating laser 10 is directed through the beam combiner optic 16, then through a beam splitter optic 18, to a laser light focusing lens 28.

A photodetector 24 can be used to monitor the timing and signal amplitude of laser pulses diverted by the beam splitter optic 22, as shown in FIG. 5.

It is also possible to practice the invention using a simple turning mirror, i.e., a laser light steering mirror, in place of the beam combiner and laser steering system. This arrangement is shown schematically in FIG. 6 wherein the laser light steering mirror 14 is offset from the output of the first (preheating) laser 10 to permit passage of the light from the preheating laser to the laser focusing lens without obstruction.

The laser light steering mirror 14 directs the laser beam from the second laser source 12 into a close approximation of coaxial alignment with the laser beam from the first laser source. Adjustments can be made to the steering mirror 14 until the light signal from the second laser source 12 detected at the photodetector 24 after deflection by a beam splitter optic 22 is maximized. This procedure can be used to control alignment between the laser beam paths from the first and second laser sources.

Figure 6:
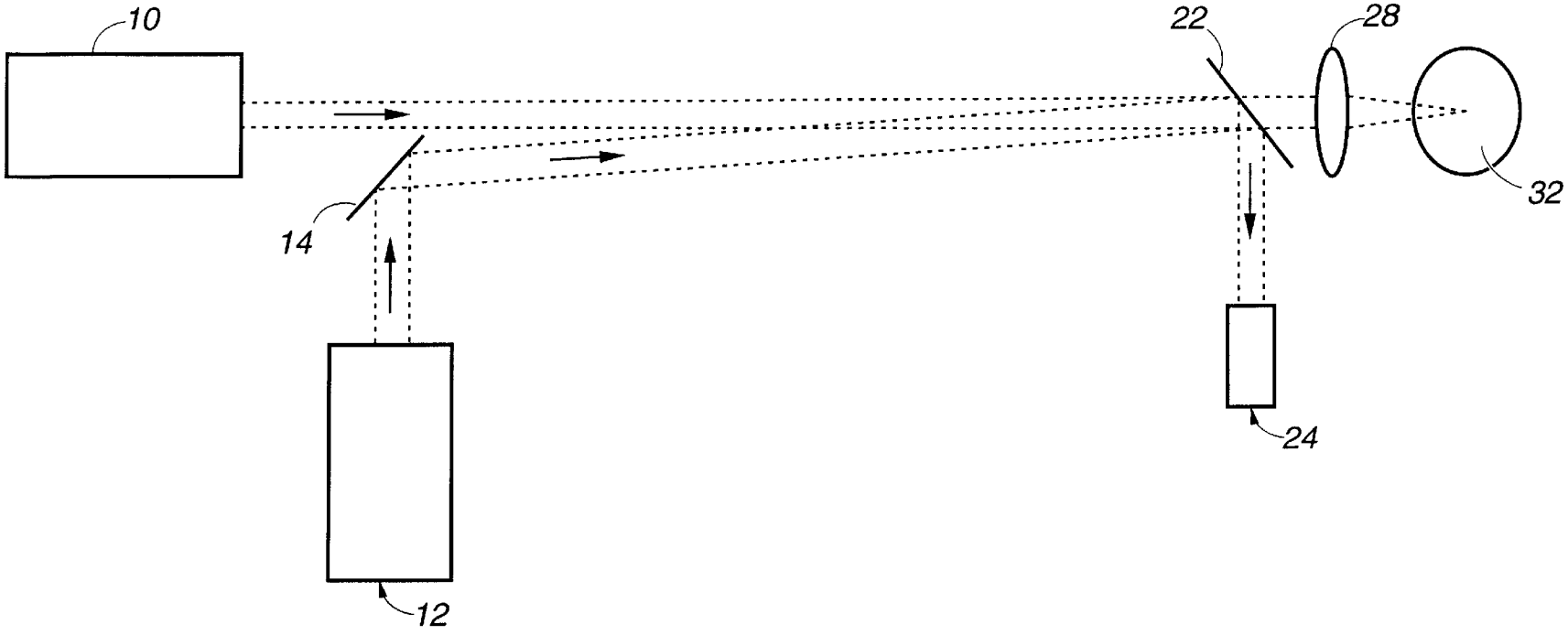
FIG. 6 is a schematic for a dual laser setup to practice the invention using a steering mirror in place of a combiner optic and laser beam steering system.

With reference to FIG. 6, the outputs from the first and second lasers 10 and 12 are propagated to the laser light focusing lens 28 so that there is a small angular offset between the incidence of the two laser beams upon the focusing lens. It is not believed that the negligible angular offset between the incidence of the two laser beams upon the focusing lens significantly affects the performance of the invention. This was demonstrated in Example II.

It may be desirable to employ a laser light steering mirror in place of the beam combiner and laser steering system when the wavelengths of the laser light provided by the preheat and the ignition lasers are such that fabrication of a beam combiner which provides sufficient transmittance and reflectivity for the two wavelengths of laser operation is not possible.

Also, when a laser light steering mirror is used in place of the beam combiner and laser steering system, the angular offset between the two laser beams of the preheat laser and the ignition laser may be used to some advantage for the ignition of fast flowing aerosols. The vaporized fuel induced by the preheating laser 10 would be carried downstream with the fuel flow and out of the focal volume before the arrival of the ignition laser light from the second laser 12. Fuel vapor motion occurring between the application of the two pulses could be compensated for by applying an angular offset sufficiently large to spatially offset the focal points of laser light from the preheating laser 10 relative to that from the igniter laser 12.

The outputs of both the preheating laser and the ignition laser can be coaxially propagated and focused into the fuel medium using the same focusing lens. However, separate focusing conditions for each of the laser light sources may be implemented to optimize fuel ignition performance.

If the first laser light is operated in a pulsed mode, the desired temporal sequencing of the laser pulses is achieved by adjusting the temporal delay between the firing of the first (preheating) laser and the second (ignition) laser. An apertured photodetector light sensor or other photodetector diagnostic instrument can be used to time the application of laser pulses so that the laser light pulse output from the preheating laser precedes the laser light output pulses of the second laser. Timing can be adjusted until the desired delay between the laser pulses is obtained at the output of the photodetector.

Figure 7:
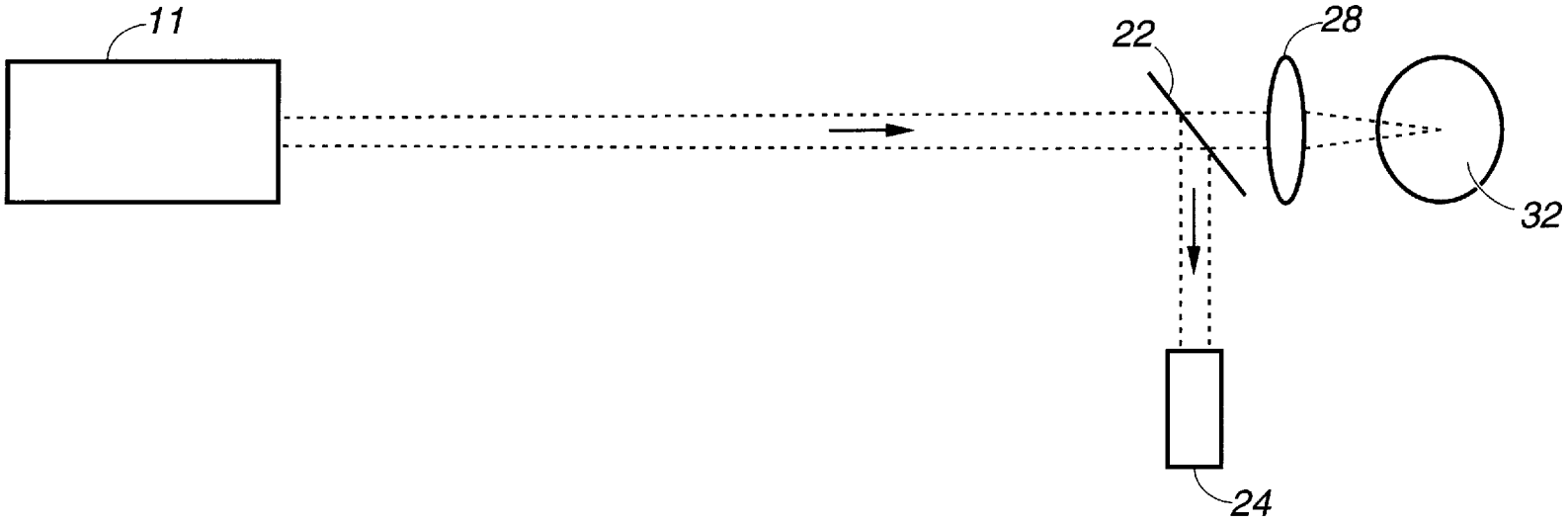
FIG. 7 is a schematic for a single laser setup to practice the invention.

The wavelength of the second laser light pulse may be identical to the first laser light pulse or may be different. When it is desired to practice the invention using a second laser light pulse at an identical wavelength as the first laser light pulse, a single laser can be utilized to propagate both the preheating laser light pulse and the spark igniter laser light pulse. An example of this is shown in the schematic of FIG. 7 comprising a single laser source 11, a beam splitting optic 22, a photodector 24, and a laser light focusing lens 28 which focuses the first and second laser light pulses into an aerosol spray 32.

At least two possibilities exist for operation of the invention apparatus using a single laser. In a first embodiment of single laser operation, the single laser source sequentially provides both the long duration, low peak power preheat pulse and the short duration, high peak power pulse. This is accomplished by alternately performing a slow and then a fast Q-switch of the laser to provide the required double pulse format.

In a second embodiment of single laser operation, the preheating laser light beam and the spark ignition laser light beam are provided by the production of a single laser pulse with sufficient pulse energy to adequately vaporize fuel droplets and also with sufficient peak power to subsequently induce a spark breakdown within the fuel. A higher pulse peak power density is required in general at the longer wavelength range to initiate a breakdown plasma which inhibits the practical application of this mode of operation.

In any of the embodiments using two laser light sources, after the second laser light source is operational and adjusted, optimal ignition performance for the specific fuel/oxidizer mixture being used is obtained by adjusting the pulse energy obtained from the first laser.

Generally, the fuel/oxidizer mixture in the aerosol cloud to be ignited is introduced into the focal volume of the laser light focusing lens after the laser light source or sources are activated and adjusted. However, once a paradigm to be used for the laser or lasers is determined, spraying of the aerosol cloud of fuel/oxidizer mixture could be started after the laser or lasers are activated. Optimal ignition performance for the specific fuel/oxidizer mixture to be ignited is obtained by adjusting the pulse energies obtained from the first laser source and second laser source and/or by adjusting the temporal delay between the temporal center of the fuel preheating laser pulse from the first laser and the laser spark igniter pulse from the second laser.

Fuels which can be preheated, then ignited using the method of this invention include, but are not limited to, hydrocarbon fuels which can be vaporized such as heating oil, kerosene, diesel, or jet fuels. The invention method is particularly useful for igniting jet fuel aerosols generated by commercial turbo-jet, forced-air atomizers; total reliability using modest laser energy has been achieved.

In an alternative mode of operation for this invention, the laser preheat pulse alone may be used for the specific task of warming aerosol fuel droplets prior to ignition. By elevating the temperature of the fuel droplets by application of the preheat light, the rate of evaporation of fuel from the droplet surface can be significantly increased. This greatly enhances the consistency of fuel aerosol ignition regardless of the ignition source, whether laser spark ignition is used as described in this invention or whether a conventional ignition source such as a capacitive discharge igniter (spark plug) is used.

This alternative mode of operation is particularly useful for the ignition of fuel aerosols under extremely cold conditions. The inability of conventional igniters to start turbo-jet and internal combustion engines in sub-arctic weather conditions due to cold conditions is well known. With use of the laser fuel preheating step of this invention, consistent ignition of jet fuel cooled to −50° F. has been obtained by applying laser preheat light to the fuel aerosol at a power density insufficient to vaporize the fuel droplets but sufficient to raise fuel droplet temperature to +100° F. Ignition was then subsequently provided by laser spark. No ignition of the fuel aerosol was obtained with the laser spark alone.

The benefit of using the preheat step of the invention in this manner is the ability to enhance performance of existing igniters as well as the ability to enhance performance of the next generation of igniters such as laser-based ignition systems. The low peak power laser light required for preheating can be readily transported by optic fiber and the long pulse energy, long duration laser pulses needed for preheating can be produced by a solid state laser or diode laser of very small physical size.

Following ignition of aerosol fuel/oxidizer mixtures, the fuel preheat method of this invention can be employed to enhance the stability of fuel combustion by pre-vaporization of fuel droplets during continued combustion. Particularly when burning a lean mix of fuel and oxidizer, local conditions and stoichiometry within the flame may vary. The flame will burn at a rate dependent upon the stoichiometry of the fuel mixture. Continuing to contact the fuel with the low peak power preheat laser of this invention can be used to regulate the burning of the fuel by controlling the local fuel/air mix conditions by pre-vaporizing fuel droplets.

The application of laser light in accordance with the practice of this invention provides a reliable and energy efficient process for initiating and sustaining the ignition of aerosol fuel/oxidizer mixtures over a wide range of fuel parameters. Ignition performance obtained by this invention significantly exceeds that obtained by conventional laser spark breakdown fuel ignition.

Peak power requirements of both the preheat laser light and laser spark igniter pulses needed to induce fuel ignition are significantly below peak power requirements for reliable fuel ignition by conventional laser spark methods. These lower peak power requirements reduce laser size and complexity and greatly facilitate transport of laser light through optical fibers for laser igniter applications. This substantially reduces problems associated with the transport of high peak power light and damage to optical elements such as the transport fiber and reflection surfaces.

Since the fuel aerosol is pre-vaporized using the ignition method of this invention, the highly detrimental effects of low initial fuel temperature on ignition performance is entirely avoided. As a result, cold fuel may be ignited with the same reliability as warm fuel.

The following examples will demonstrate the operability of the invention.

EXAMPLE I

A theoretical model describing the interaction of preheating laser light with fuel droplets resulting in the heating and vaporization of droplets traversing the laser light was developed.

For purposes of this calculation, the fuel droplets were assumed to be traversing the laser light within the focal volume in a direction perpendicular to the direction of the laser light.

The calculation assumed triangular spatial and temporal distribution of the pulsed laser light within the focal point of the focusing lens. In this calculation, the temporal pulse length of the laser pulse was assumed to be a constant 120 microseconds (FWHM), although the laser waist diameter within the focal plane was permitted to vary.

The model calculated the heating of a fuel droplet of a given diameter (190 microns) when the droplet first entered the focal volume as the laser pulse first arrived.

The calculation assumed a constant laser pulse energy of 0.4 J.

Figure 8:
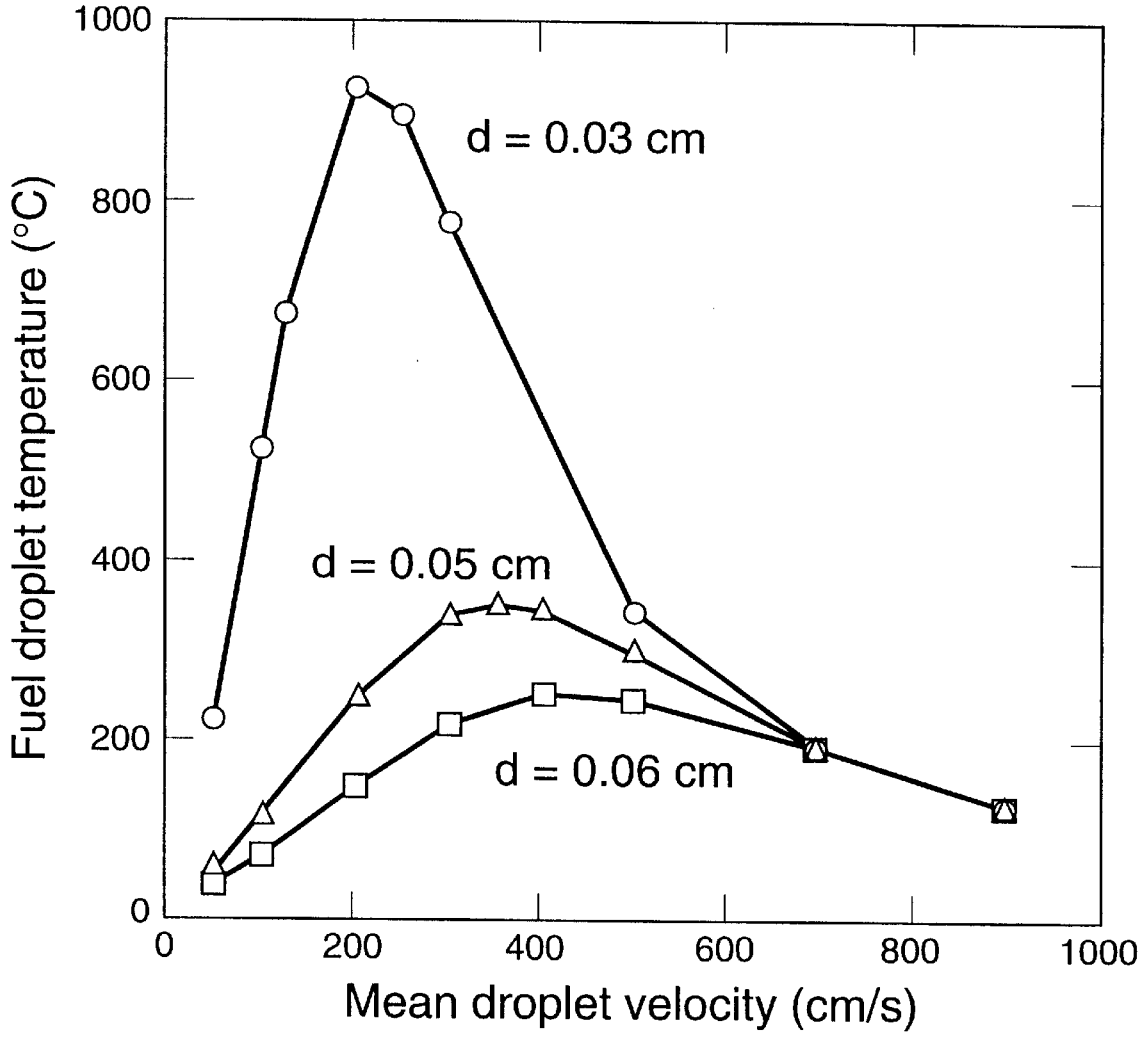
FIG. 8 is a plot of fuel droplet temperature as a function of mean droplet velocity for several laser spot sizes.

A result of the calculation of this example is shown in FIG. 8, where the temperature of the fuel droplet passing through the laser spot is plotted versus mean droplet velocity for several laser spot sizes. The laser beam waist of 0.03 cm (FWHM) corresponds to the experimental conditions given in Example II.

As can be seen from the FIG. 8, for any condition of laser light focusing, there is an optimum droplet velocity at which the maximum coupling between the laser light and the fuel droplet occurs and at which the maximum possible fuel temperature is achieved. According to the calculation of this example, for a laser spot size of 0.03 cm diameter, droplets with a mean velocity of about 220 cm/second are heated most efficiently.

The optical focal condition corresponds to a close matching of the laser temporal width to the time it takes for the fuel droplet to pass through the laser spot. As the mean droplet velocity increased, the effective laser heating decreased. At droplet speeds as high as 680 cm/second, the graph of temperature as a function of velocity showed that sufficient heating of the droplet still occurs to elevate the droplet temperature to 200° C., the boiling point of the fuel. Therefore, to the model of this example, at this droplet speed and internal temperature, vaporization would still occur. The model was consistent with the experimental results obtained in Example II, where the laser light was focused into an fuel aerosol cloud in which mean droplet velocities were no larger than 700 cm/second; vaporization of fuel droplets was readily observed.

Figure 9:
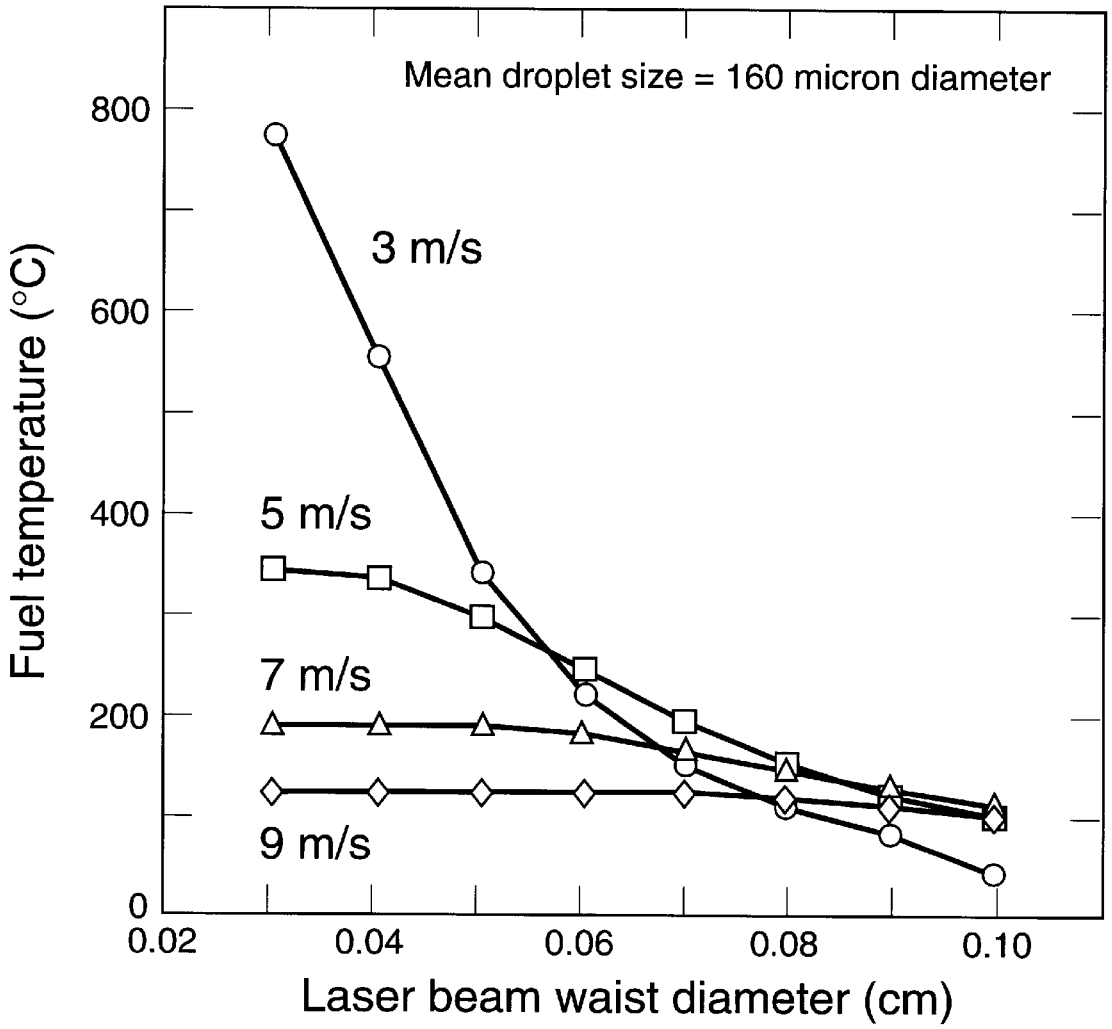
FIG. 9 is a plot of fuel droplet temperature as a function of laser spot diameter for several mean droplet velocities.

FIG. 9 is a graph of fuel droplet temperature as a function of laser spot diameter for several mean droplet velocities. In general, as the diameter of the laser spot was increased, the amount of droplet heating decreased. This was believed to be due to the lower laser light power density in the focal plane. The lower laser light power density in the focal plane was compensated for to some degree by a longer dwell time over which laser light was incident upon the fuel droplet. This effect was seen for the cases of relatively fast droplets with speeds of 5 meters/second or more in which the resultant heating of the droplet was nearly constant over a broad range of laser beam spot diameters.

The model also showed no dependence of fuel heating upon droplet size; a significant advantage of the preheat ignition methods of this invention.

EXAMPLE II

An aerosol of Jet A fuel, produced by a forced-air, fuel atomizer of a type used in commercial turbo-jet aircraft was used to demonstrate operability of the invention. Mean droplet size was 190 microns and ranged from about 150 microns to about 210 microns, depending upon location of the droplet within the fuel aerosol.

Equipment for this example was set up as shown in the schematic of FIG. 6, with a first (preheat) laser 10, a second (igniter) laser 12, a turning mirror 14, a beam splitter 22, a photodetector 24, and a laser focusing lens 28.

For the preheating step, a Er:YAG laser operating at a wavelength of 2.94 microns and a pulse width of 120 microseconds (FWHM) was used to vaporize droplets of an aerosol fuel.

The laser light was focused to a spot size of about 0.3 mm within the aerosol using a 10-cm focal length lens.

The Er:YAG laser was operated at a 1 Hz pulse rate.

Figure 10:
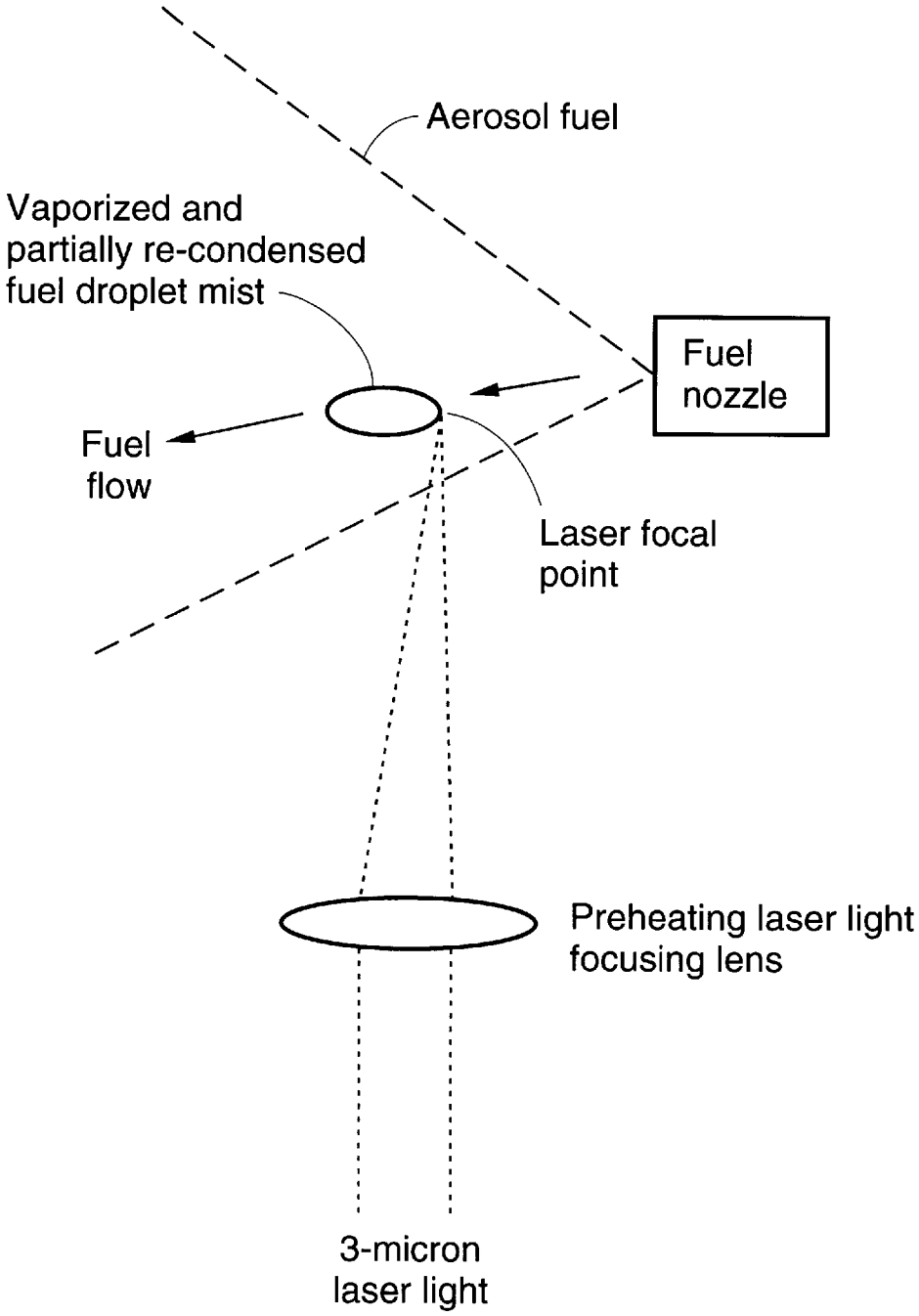
FIG. 10 is a schematic of the vaporization/pre-ignition step of the invention.

The vaporization of many individual fuel droplets within the Jet A fuel aerosol plume generated by the commercial turbo-jet atomizer was observed experimentally following the application of a single 2.94 micron laser light pulse. The experimental observation of fuel droplet vaporization is diagrammed in FIG. 10. The circled feature in FIG. 10 is a fuel mist cloud resulting from the vaporization of fuel droplets along the path of the laser light through the fuel aerosol and subsequent re-condensation into a mist of finely divided fuel droplets.

The measured absorption length of 2.94 micron laser light within Jet A fuel was significant (6.5 $cm^{-1}$). Calculations indicated a 2.94 micron absorption sufficiently large at an Er:YAG pulse energy of 400 mJ to permit the heating of individual Jet A aerosol droplets to the fuel boiling point of about 200° C.

A Q-switched Nd:YAG laser operating at 1.064 microns with a temporal pulse width of 12 nanoseconds FWHM was used as a second laser to ignite the vaporized fuel. A laser pulse energy of 91 mJ was used. The temporal separation between the application of the Er:YAG laser pre-heat pulse and the igniting laser light pulse was 50 nanoseconds.

With reference to FIG. 6, the outputs from the preheating laser 10 and the igniter laser 12 were not propagated coaxially to the laser light focusing lens 28, but rather had a small angular offset between the incidence of the two laser beams upon the laser focusing lens 28. The angular offset of the laser light focal points at the focal plane was negligible and did not appreciably influence the performance of the invention.

The Nd:YAG light pulse within the fuel aerosol cloud 32 was focused by the same lens used to focus the 2.94 micron Er:YAG light.

The Nd:YAG laser induced spark breakdown when focused by a 10 cm focal length lens into the vaporized fuel/air mixture. To induce fuel ignition at various locations within the aerosol, the focusing lens was physically moved in the direction transverse to the symmetry axis of the aerosol plume.

The heating of fuel droplets by laser light at a wavelength which was readily absorbed by the fuel occurred in a configuration identical to that predicted by the theoretical model of Example I.

Ignition performance provided by the preheating and vaporization of the Jet A fuel prior to ignition by laser spark breakdown as described in this example was significantly better than that obtained by laser spark breakdown alone. Fuel ignition probability as a function of the position in which the laser breakdown spark was induced within the aerosol cloud is plotted in the graph of FIG. 11. Preheat laser pulse energy was 400 mJ. Preheat laser pulse width was 120 microsecs. Igniter laser pulse energy was 91 mJ. Igniter laser pulse width was 12 ns. Fuel pressure used was 25 psia; air flow was 1.0 inches water 1.0 cm from nozzle. The data shown in FIG. 11 was obtained when the focusing lens was moved in the direction transverse to the symmetry axis of the aerosol plume with positive values designating positions closer to the laser light source.

Figure 11:
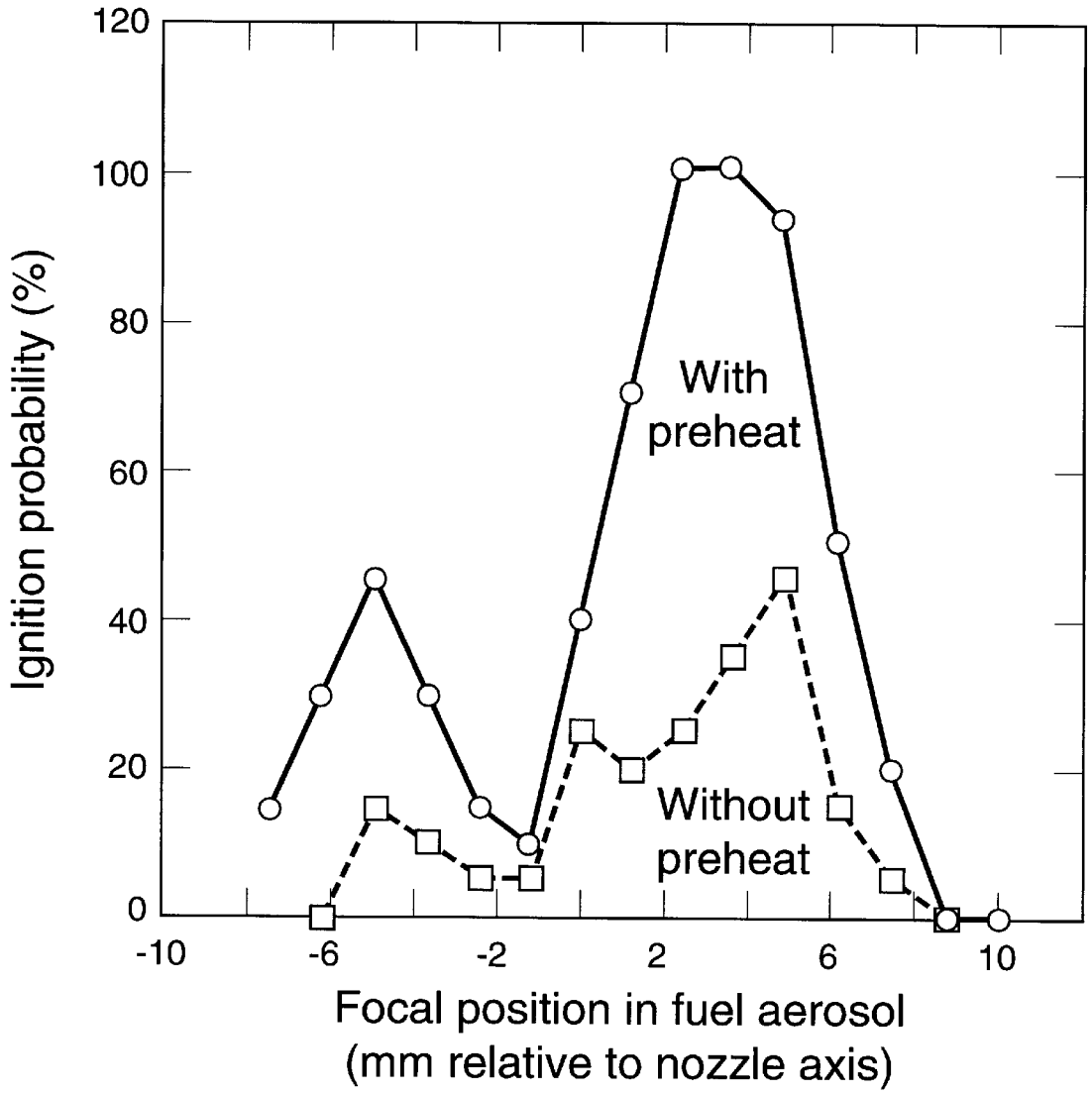
FIG. 11 is a graph of ignition probability using the invention method compared with state-of-the-art ignition probability.

The solid curve in FIG. 11 describes the enhanced ignition performance obtained with 2.94 micron laser light preheating of fuel droplets. Consistent, 100% reliable fuel aerosol ignition was obtained at optimal focal locations within the fuel aerosol cloud.

The dashed curve in FIG. 11 shows the relatively poor ignition performance obtained when the 2.94 micron laser was not operated.

While the apparatuses and methods of this invention have been described in detail for the purpose of illustration, the inventive apparatuses and methods are not to be construed as limited thereby. This patent is intended to cover all changes and modifications within the spirit and scope thereof.

INDUSTRIAL APPLICABILITY

The methods of this invention can be used to significantly improve ignition performance. Applications include, but are not limited to, advanced turbo-jet engine ignition systems and flame stabilization applications.

What is claimed is:

1. A method for laser ignition comprising:

(a) contacting a fuel aerosol with a first low peak power laser light pulse having a wavelength which coincides with an absorption band of the fuel thereby forming heated and vaporized droplets of said fuel aerosol; thereafter (b) contacting said vaporized fuel with a second high peak power laser light pulse of sufficient intensity to ignite said vaporized fuel.

2. A method as recited in claim 1:

(a) wherein said first laser light pulse has a wavelength in the range from about 2 to about 12 microns, a pulse length in the range from about 1 nanosecond to about 1 milliseconds, and a power density in the range from about 5 $kW/cm^2$ to about $5\times10^{11}$ $W/cm^2$; and (b) wherein said second laser light pulse has a wavelength in the range from about 250 nanometers to about 10 microns, a pulse length in the range from about 0.1 to about 400 nanoseconds, and a power density in the range from about $10^8$ to about $10^{12}$ $W/cm^2$.

3. A method as recited in claim 2 wherein said first laser light pulse length is no longer than a time required for said fuel droplets to traverse the region of focused laser light.

4. A method as recited in claim 1 wherein said first laser light pulse is operated in continuous mode.

5. A method as recited in claim 1 wherein there is an interval between said first laser light pulse and said second laser light pulse in the range from about 0 to about 100 microseconds.

6. A method as recited in claim 1 wherein said first laser light pulse and said second laser light pulse are coaxial with respect to said vaporized fuel.

7. A method as recited in claim 1 wherein said first laser light pulse and said second laser light pulse are focused into a region of said fuel aerosol where the highest concentration of fuel droplets occurs.

8. A method for improving ignition comprising:

(a) preheating a fuel aerosol with a low peak power, long duration laser light pulse, thereby heating and vaporizing droplets of said fuel aerosol; and thereafter (b) contacting said vaporized fuel with a high peak power, short duration laser light pulse, thereby igniting said vaporized fuel.

9. A method as recited in claim 8, (a) wherein said fuel aerosol is preheated by contacting it with a first laser light pulse having a wavelength in the range from about 2 to about 12 microns, a pulse length in the range from about 1 nanosecond to about 1 milliseconds, and a power density in the range from about 5 $kW/cm^2$ to about $5\times10^{11}$ $W/cm^2$, thereby heating and vaporizing said droplets of said fuel aerosol; and (b) wherein said vaporized fuel is ignited by contacting said vaporized fuel with a second laser light pulse having a wavelength in the range from about 250 nanometers to about 10 microns, a pulse length in the range from about 0.1 to about 400 nanoseconds, and a power density in the range from about $10^8$ to about $10^{12}$ $W/cm^2$.

10. A method for stabilization of flames comprising:

(a) contacting a fuel aerosol with a first low peak power laser light pulse at a wavelength that is absorbable by droplets of said fuel aerosol, thereby producing a hot cloud of vaporized fuel;

(b) continuing to contact said fuel aerosol with said first low peak power laser light pulse during ignition of said fuel aerosol with a second high peak power laser light pulse of sufficient intensity to ignite said vaporized fuel.

11. A method as recited in claim 10 where said first laser light pulse has a wavelength in the range from about 2 to about 12 microns, has a pulse length in the range from about 1 nanosecond to about 1 millisecond, and has a power density in the range from about 5 $kW/cm^2$ to about $5\times10^{11}$ $W/cm^2$ and said second laser light pulse has a wavelength in the range from about 250 nanometers to about 10 microns, a pulse length in the range from about 0.1 to about 400 nanoseconds, and a power density in the range from about $10^8$ to about $10^{12}$ $W/cm^2$.

* * * * *